US006015205A

United States Patent [19]

Chambers et al.

[11] Patent Number: 6,015,205

[45] Date of Patent: Jan. 18, 2000

[54] PRINT HEAD RESTRAINT MECHANISM

[75] Inventors: Richard G. Chambers, Portland, Oreg.; Kenichi Naruki, Hiroshima, Japan

[73] Assignee: Tektronix, Inc., Wilsonville, Oreg.

[21] Appl. No.: 08/937,424

[22] Filed: Sep. 25, 1997

[51] Int. Cl.[7] ..... B41J 25/308

[52] U.S. Cl. ..... 347/37; 347/8

[58] Field of Search ..... 347/37, 8, 14, 347/23; 400/174, 175

[56] References Cited

U.S. PATENT DOCUMENTS

| | | | |
|---|---|---|---|
| 4,538,156 | 8/1985 | Durkee et al. | 346/21 |
| 4,843,338 | 6/1989 | Rasmussen et al. | 347/8 |
| 4,952,084 | 8/1990 | Maruyama | 400/120.16 |
| 4,990,004 | 2/1991 | Kawahara et al. | 400/56 |
| 5,502,476 | 3/1996 | Neal et al. | 347/103 |
| 5,608,430 | 3/1997 | Jones et al. | 347/8 |

OTHER PUBLICATIONS

Tektronix, Inc. 1995, "Phaser® 340 Color Printer–Service Manual", First Printing Final Feb. 17, pp. A–4 to A–7 (4 pages);.

Tektronix, Inc. 1996, "Phaser® 350 Color Printer–User Manual", First Printing Aug. 1996, pp. 2–10 and 5–34 (2 pages).

*Primary Examiner*—N. Le
*Assistant Examiner*—Anh T. N. Vo
*Attorney, Agent, or Firm*—Charles F. Moore

[57] ABSTRACT

A print head restraint mechanism for limiting movement of a print head during transport of the printing apparatus is provided. The restraint mechanism includes a moveable pin that selectively engages the print head. An engaging mechanism moves the pin into and out of engagement with the print head when the print head is positioned in a restraint position. During printing the restraint mechanism is positioned away from the travel path of the print head to avoid interfering with print head motion. An interlock prevents actuation of the restraint mechanism when the print head is away from the restraint position.

19 Claims, 8 Drawing Sheets

PRINT HEAD RESTRAINT MECHANISM

TECHNICAL FIELD

The present invention relates generally to printing, and more particularly to a print head restraint mechanism that limits motion of a print head to protect the print head and maintain component alignment during transportation.

BACKGROUND OF THE INVENTION

Many printing and imaging systems utilize a print head to effect imaging on a final receiving medium. Ink-jet printing systems commonly utilize either direct printing or offset printing architecture. In a typical direct printing system ink is ejected from jets in the print head directly onto the final receiving medium. In an offset printing system, the print head jets the ink onto an intermediate transfer surface, such as a liquid layer on a drum. The final receiving medium is then brought into contact with the intermediate transfer surface and the ink image is transferred and fused or fixed to the medium.

In some direct and offset printing systems, the print head moves relative to the final receiving medium or the intermediate transfer surface in two dimensions as the print head jets are fired. Typically, the print head is translated along an X-axis while the final receiving medium/intermediate transfer surface is moved along a Y-axis. In this manner, the print head "scans" over the print medium and forms a dot-matrix image by selectively depositing ink drops at specific locations on the medium.

When moving or transporting a printing system that includes a print head, it is desirable to restrain or secure the print head to limit its motion. In this manner, the print head is protected from inadvertently contacting other internal components of the printer and possibly suffering damage or being jolted out of alignment should the printer experience a shock loading or other deleterious movement during transport. An exemplary mechanism for restraining a print head is found in the Phaser® 350 solid ink color printer manufactured by Tektronix, Inc. of Wilsonville, Oreg. This restraint mechanism comprises a first pin mounted on the end of a shaft that is axially aligned with a first boss on one side of the print head. To restrain the print head, the print head is tilted away from the printing position and is translated until a second boss on an opposite side of the print head engages a second, fixed pin within the printer. The operator then depresses a button on the side frame of the printer to translate the shaft and engage the first pin in the first boss on the print head.

As this mechanism fixedly positions the moveable shaft and pin within the X-axis travel path of the print head, it is most suitable for use with print heads that travel smaller distances along the X-axis during printing. In printers having a print head that translates greater distances along the X-axis, the above-described mechanism is less desirable. In these printers, the shaft and pin of this mechanism would need to be positioned a greater distance away from the print head to avoid interfering with print head travel during printing. This increases the width of the printer housing or requires the shaft to protrude from one end of the printer housing.

Thus, a need exists for a print head restraint system that is suitable for use with print heads that translate substantial distances during printing. The restraint mechanism should not interfere with normal printing operations and should be easy to actuate by an operator. The restraint mechanism should also include provisions that prevent its actuation during imaging and at all other times when actuation could result in damage to the print head.

SUMMARY OF THE INVENTION

It is an aspect of the present invention to provide a print head restraint mechanism for selectively limiting the movement of a print head.

It is another aspect of the present invention to provide a print head restraint mechanism that is positioned away from and in a non-interfering relationship with the travel path of the print head during printing.

It is yet another aspect of the present invention to provide a print head restraint mechanism that includes a moveable pin that engages the print head.

It is still another aspect of the present invention that the print head restraint mechanism includes a fixed pin that engages the print head when the print head is in a restraint position.

It is a feature of the present invention that the print head restraint mechanism is easily engaged and disengaged by an operator.

It is another feature of the present invention that the print head restraint mechanism includes a sensor that detects when the moveable pin is in the disengaged position.

It is an advantage of the present invention that the print head restraint mechanism may be used with wide format and other printers in which a print head translates substantial distances during printing.

It is another advantage of the present invention that the print head restraint mechanism includes an interlock to prevent actuation of the mechanism when the print head is away from a restraint position.

To achieve the foregoing and other aspects, features and advantages, and in accordance with the purposes of the present invention as described herein, an improved print head restraint mechanism is provided. The print head restraint mechanism is positioned away from and in a non-interfering relationship with the travel path of the print head during printing. The restraint mechanism includes a moveable pin that selectively engages the print head to limit movement of the print head during transport. An engaging mechanism moves the pin into and out of engagement with the print head when the print head is positioned in a restraint position. An interlock prevents actuation of the restraint mechanism when the print head is away from the restraint position.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

DETAILED DESCRIPTION OF THE PREFERRED EMBODIMENT

Figure 1:
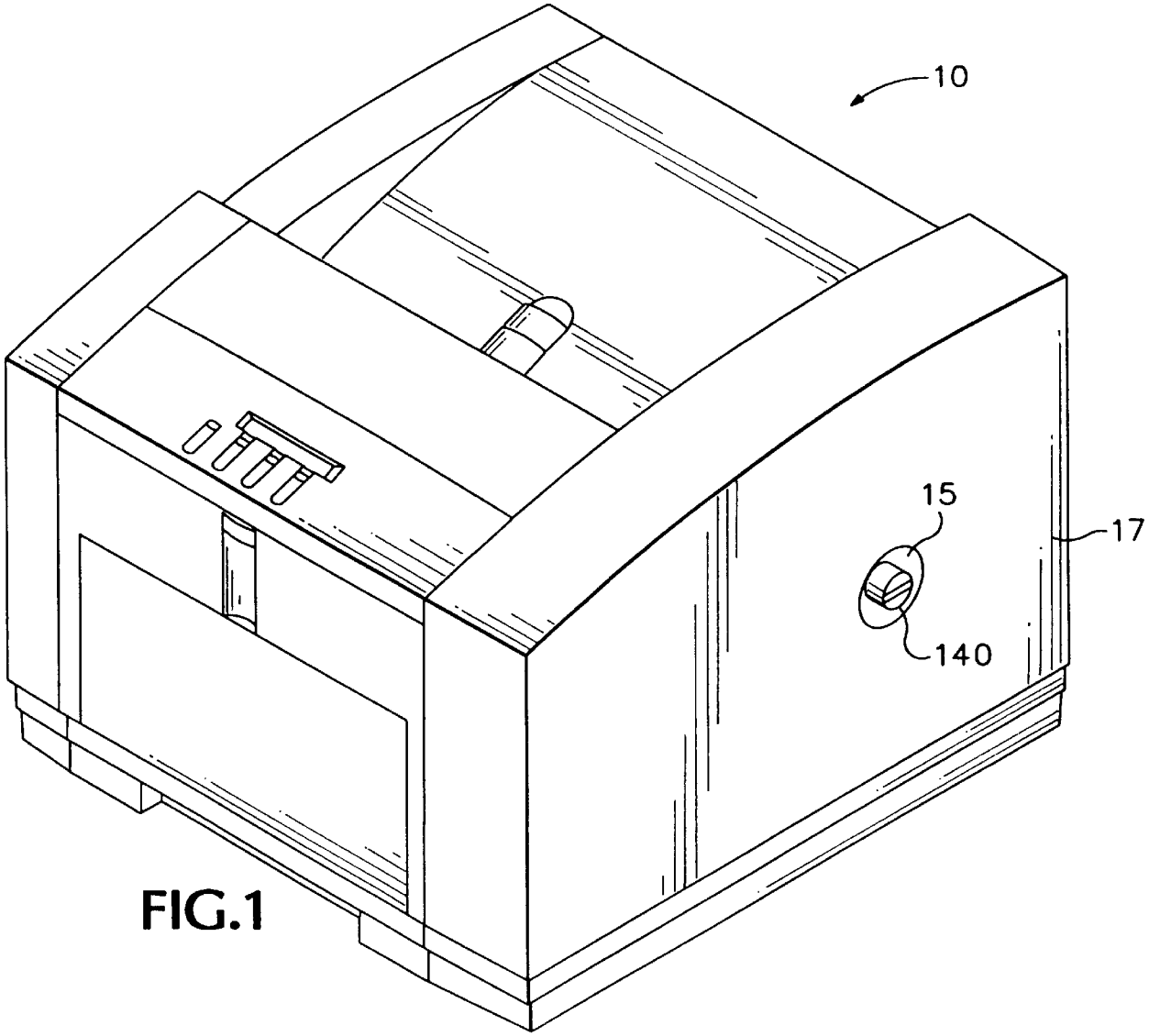
FIG. 1 is an overall perspective view of a solid ink-jet transfer color printer that utilizes the print head restraint mechanism of the present invention.

FIG. 1 shows an overall view of a solid ink-jet color printing apparatus, generally represented by the reference numeral 10, that utilizes a transfer or offset printing process and incorporates the print head restraint mechanism of the present invention. An example of a suitable transfer ink-jet color printer with which the present invention may be utilized is disclosed in U.S. Pat. No. 5,502,476 (the '476 patent), entitled METHOD AND APPARATUS FOR CONTROLLING A PHASE-CHANGE INK TEMPERATURE DURING A TRANSFER PRINTING PROCESS, and assigned to the assignee of the present application. The '476 patent is hereby specifically incorporated by reference in pertinent part. The following description of a preferred embodiment of the present invention refers to its use in this type of printing apparatus. It will be appreciated, however, that the print head restraint mechanism of the present invention may be used with other printing apparatus that utilize different architectures, such as direct printing apparatus in which ink is jetted directly onto a receiving medium, and with various other printing, imaging and/or copying apparatus and systems. Accordingly, the following description will be regarded as merely illustrative of one embodiment of the present invention, and should not be interpreted as in any way limiting the invention to transfer ink-jet color printers.

Figure 2:
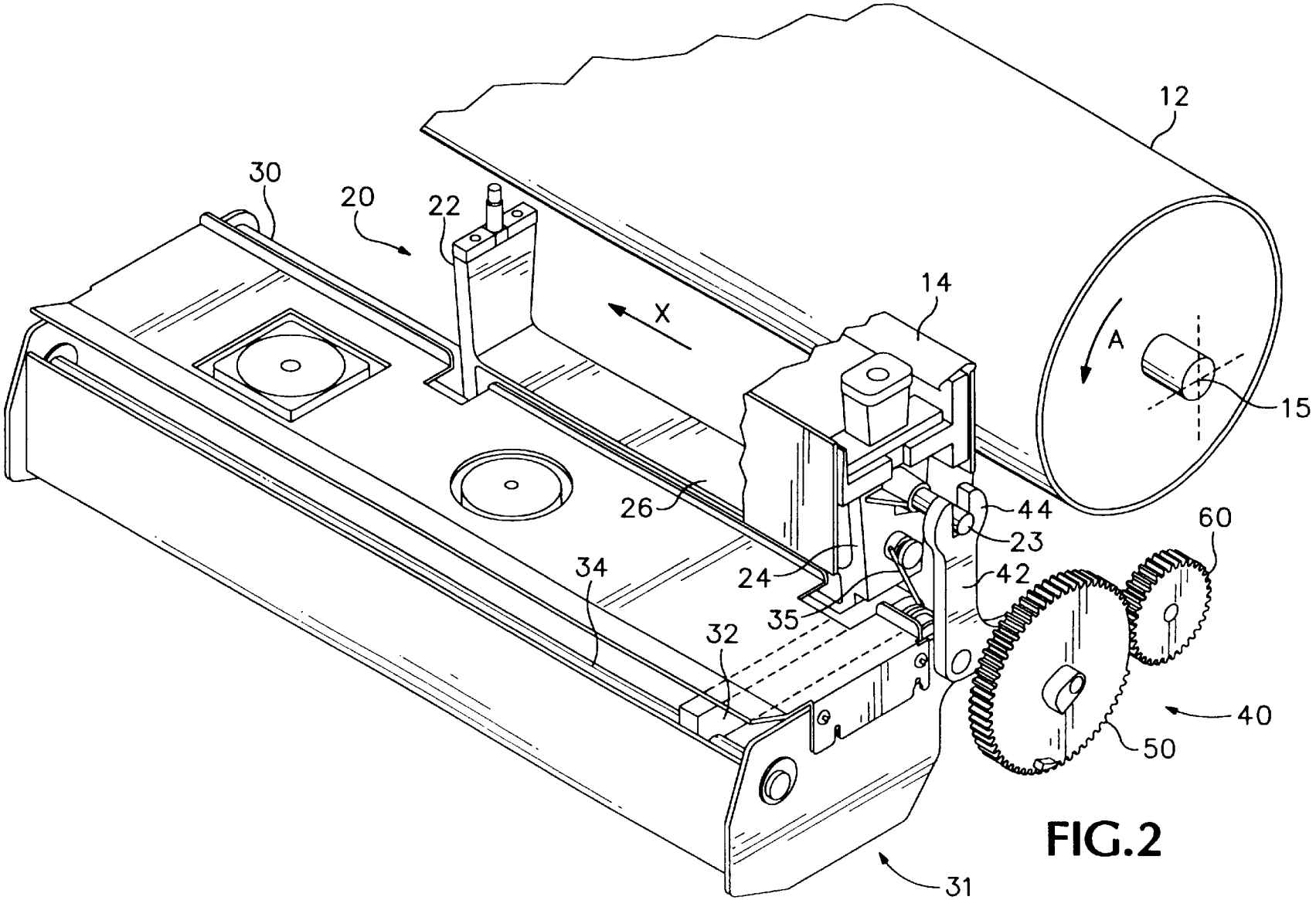
FIG. 2 is a perspective diagram showing the carriage and a cut-away portion of the print head in the printing position with the fork of the tilt arm capturing the pin of the carriage.
Figure 3:
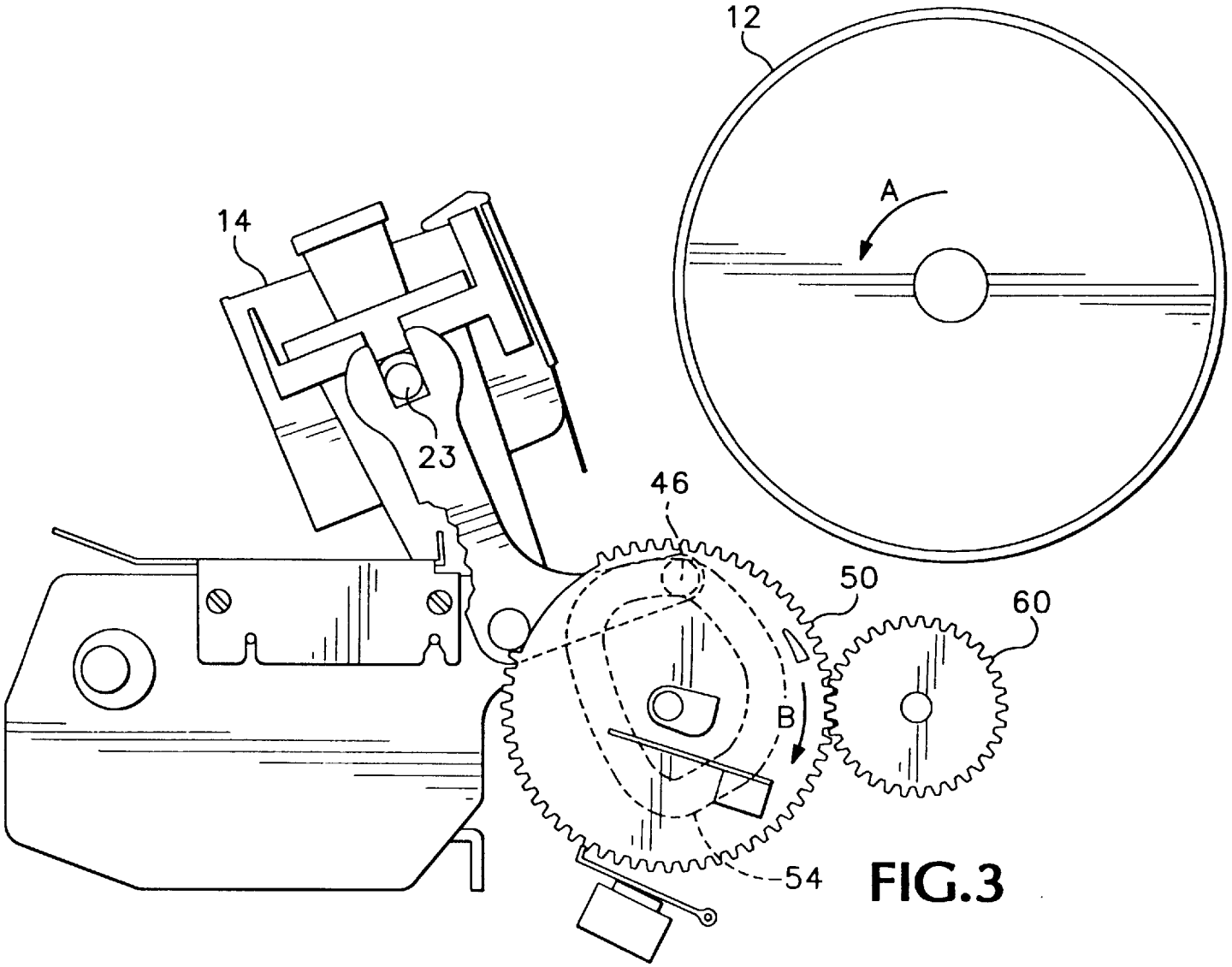
FIG. 3 is a side elevational view showing the print head tilt mechanism, carriage and print head in a maximum tilt position.

With reference to FIGS. 2 and 3, the printing apparatus 10 includes an image receiving medium in the form of a transfer drum 12 that rotates in the direction of action arrow A. Prior to printing, an intermediate transfer surface (not shown) is applied to the drum 12. A print head 14, partially shown in FIG. 2 and preferably having an array of ink-jet nozzles (not shown), is spaced apart from the drum 12 and ejects liquid ink onto the intermediate transfer surface to form an ink image thereon. The image receiving medium to which the intermediate transfer surface is applied may take the form of a drum 12 as shown in FIGS. 2 and 3, or alternatively may be a belt, web, platen or other suitable design.

In operation the print head 14 is moved parallel to the transfer drum 12 along an X-axis as the drum 12 is rotated and the print head jets (not shown) are fired. In this manner, an ink image is deposited on the intermediate transfer surface that is supported by the outer surface of the drum 12. When the image is fully deposited on the intermediate transfer surface, a final receiving medium, such as a sheet of paper or a transparency, is brought into contact with the transfer drum 12, and the deposited image is simultaneously transferred and fixed (transfixed) to the medium.

With continued reference to FIGS. 2 and 3, the print head 14 is mounted on a carnage, generally designated by the reference numeral 20. The carriage 20 includes opposing first and second flanges 22, 24, respectively, that extend upwardly from a base 26. The carriage 20 is slidably and rotatably mounted on a front guide shaft 30 that extends parallel to the drum 12 and is supported by a mounting chassis 31. A stabilizing arm 32 slidably connects the carriage 20 to a rear guide shaft 34 that is parallel to the front guide shaft 30. A coil spring 35 on the front guide shaft 30 biases the carriage 20 and print head 14 toward the drum 12.

The carriage 20 and attached print head 14 are slidingly translated along the front and rear guide shafts 30, 34 parallel to the axis of rotation 15 of the drum 12 in the directions of action arrow X by an X-axis drive mechanism (not shown). An example of a suitable X-axis drive mechanism is disclosed in co-pending application Ser. No. 08/757,366 for IMAGE DEPOSITION METHOD, which application is specifically incorporated by reference in pertinent part. It will be appreciated by those skilled in the art that various other mechanisms for translating the carriage 20 and print head 14 in the X-axis direction may be utilized with the present invention.

The print head 14 is moved toward and away from the drum 12 by a print head tilt mechanism, generally indicated by the reference numeral 40. The print head tilt mechanism 40 includes a tilt arm 42, a gear-driven cam 50, and a process gear 60, each being rotatably mounted within the printing apparatus 10. The tilt arm 42 is substantially L-shaped and includes a fork 44 at a first end and a cam follower 46 at a second end (see FIG. 3). A more detailed description of the operation of the print head tilt mechanism 40 is provided in co-pending application Ser. No. 08/900,496, entitled PRINT HEAD POSITIONER MECHANISM, which application is specifically incorporated by reference in pertinent part.

With reference now to FIG. 2, the carriage 20 and print head 14 are shown in a home position along the X-axis. In the home position, a pin 23 extending laterally from the second flange 24 of the carriage 20 is captured by the fork 44, thereby allowing the tilt arm 42 to tilt the carriage and print head 14 away from the drum 12. The tilt arm 42 tilts the carriage 20 and print head 14 between a printing position of 0 degrees (FIG. 2) and a maximum tilt or standby position of approximately 25 degrees (FIG. 3) away from the drum 12.

Figure 4:
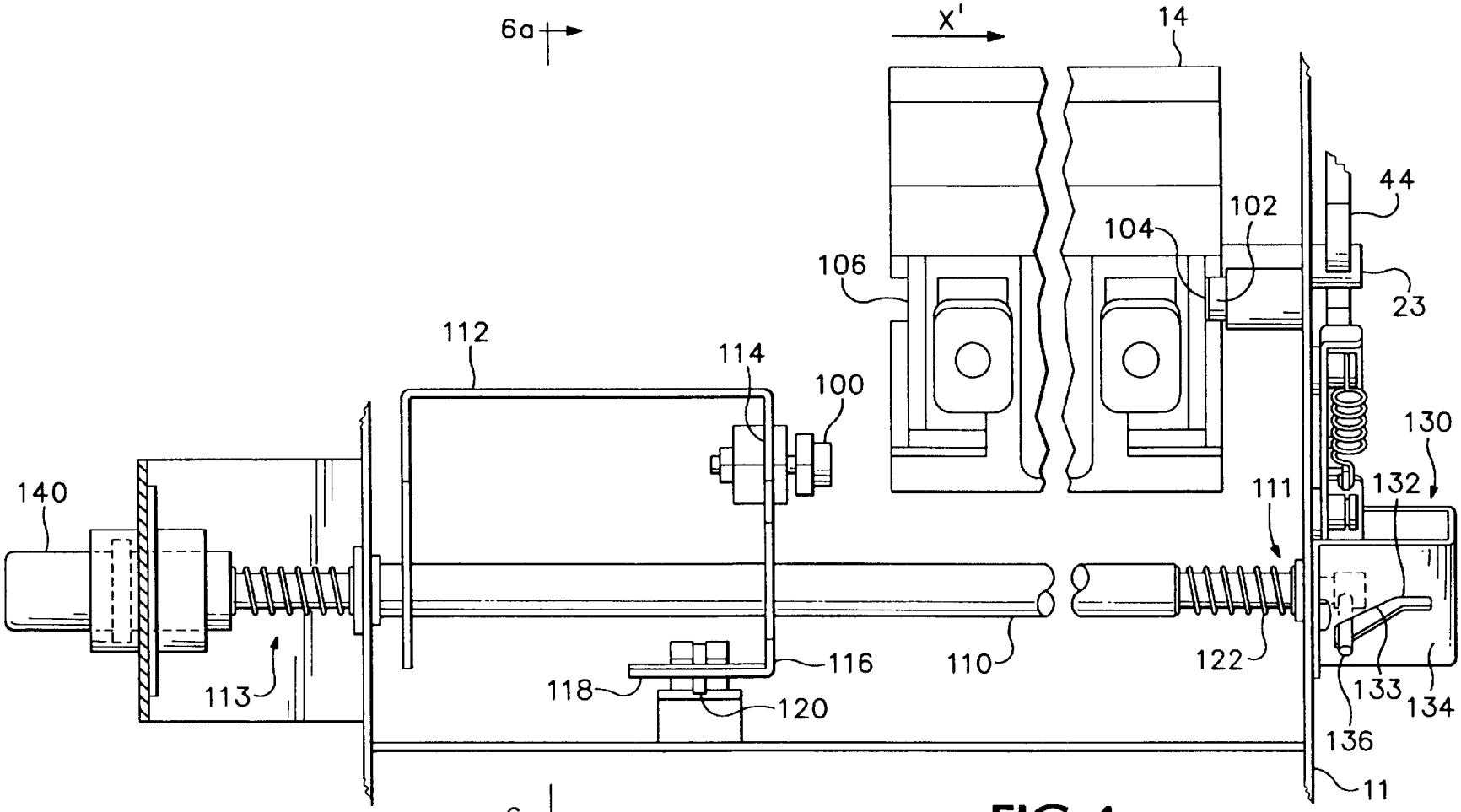
FIG. 4 is an elevational view of the print head restraint mechanism in a disengaged position.
Figure 5:
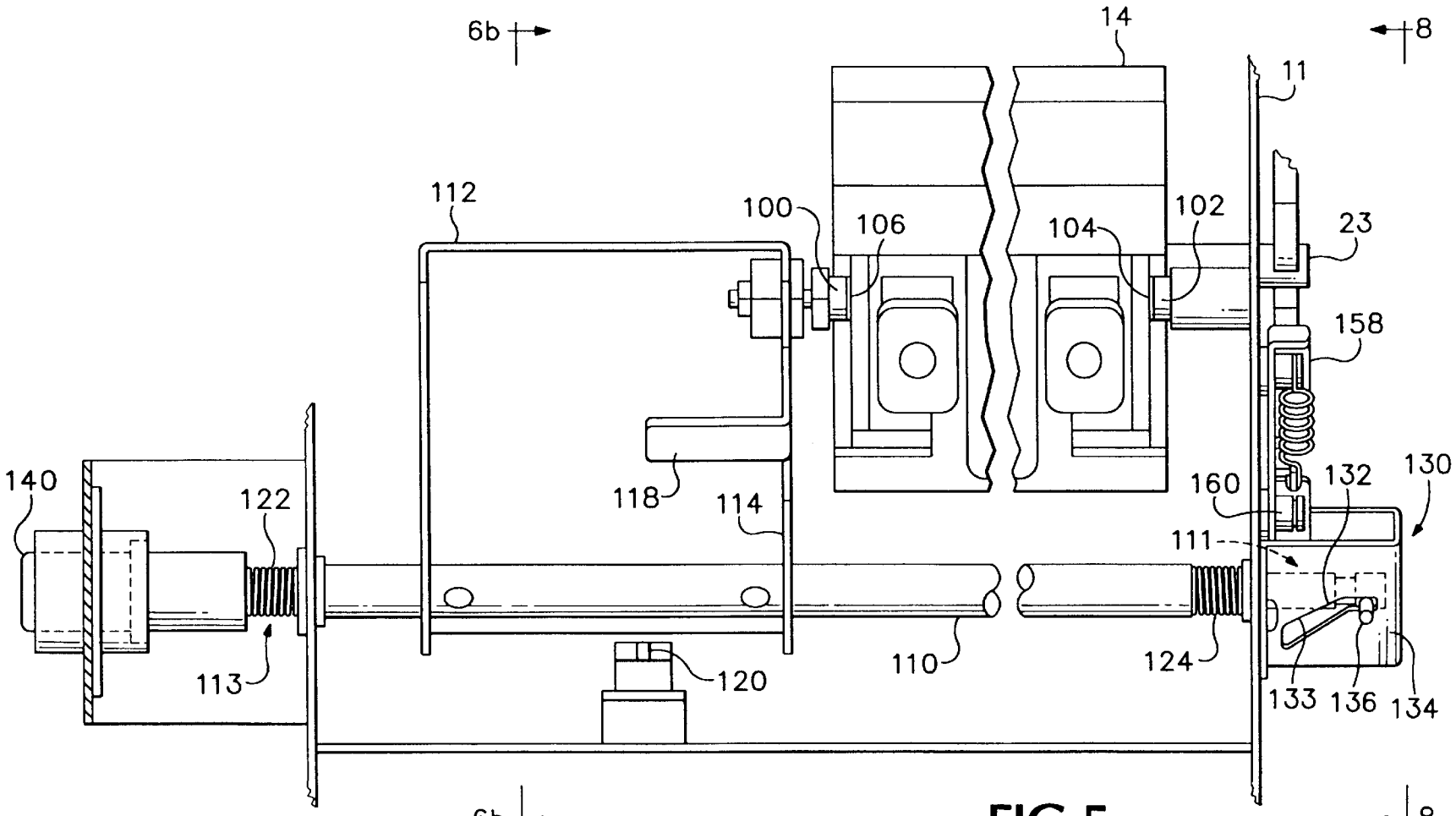
FIG. 5 is an elevational view of the print head restraint mechanism engaging in the print head.

With reference now generally to FIGS. 4–10, a preferred embodiment of the print head restraint mechanism of the present invention will now be described. As explained above, during transportation of the printing apparatus 10 it is desirable to secure or restrain the print head 14 to limit its motion. With reference now to FIGS. 4 and 5, in the present invention this is accomplished by employing an engaging apparatus that selectively engages the print head 14 to limit its movement during transport. The carriage 20 and print head 14 are first tilted to the maximum tilt/standby position of approximately 25 degrees (See FIGS. 3 and 6*b*). With reference now to FIG. 4, the carriage 20 and print head 14 are then translated in the direction of action arrow X' until a fixed pin 102 enters a first boss 104 in the print head 14. The carriage 20 and print head 14 are then tilted forward to a restraint position of approximately 24.6 degrees. This tilt move transfers the load imparted by the coil spring 35 from the gear-driven cam 50 to the fixed pin 102.

Figure 6A:
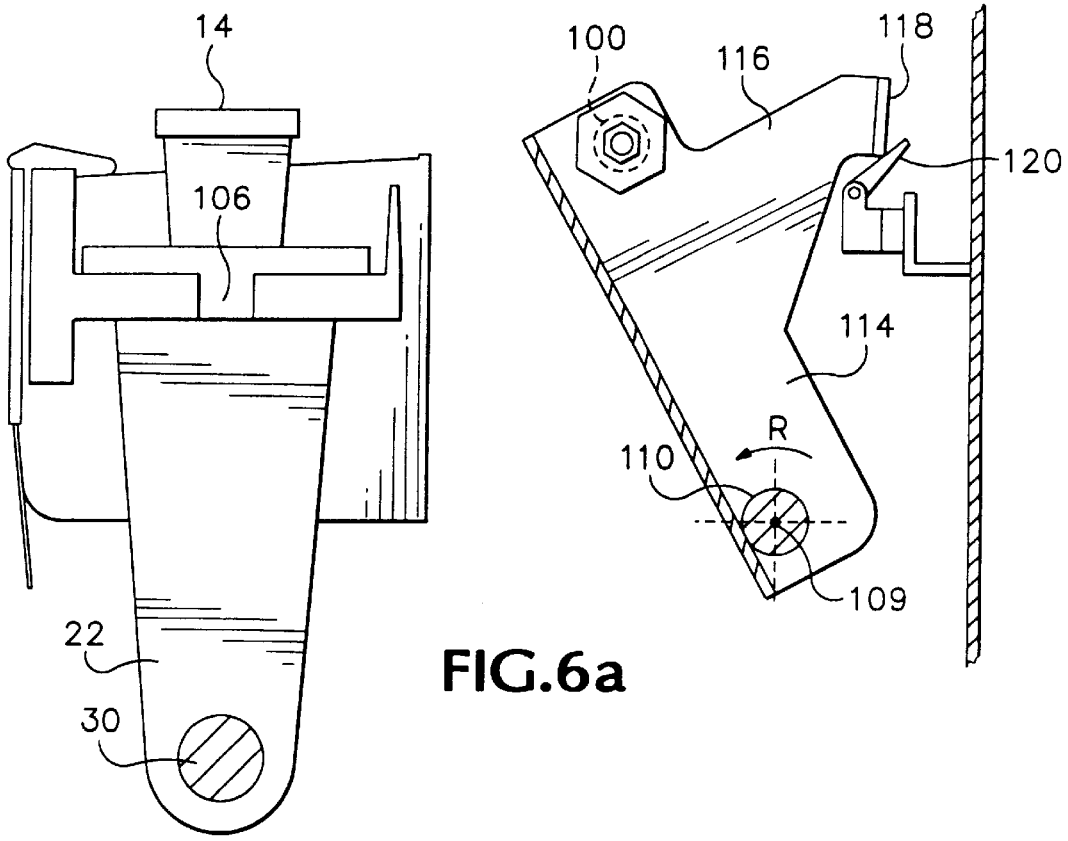
FIG. 6*a* is a side elevational view taken along the section line 6*a*—6*a* in FIG. 4 showing the print head in a printing position and the restraint mechanism in the disengaged position such that the restraint mechanism is away from the travel path of the print head to avoid interfering with print head motion during printing.
Figure 6B:
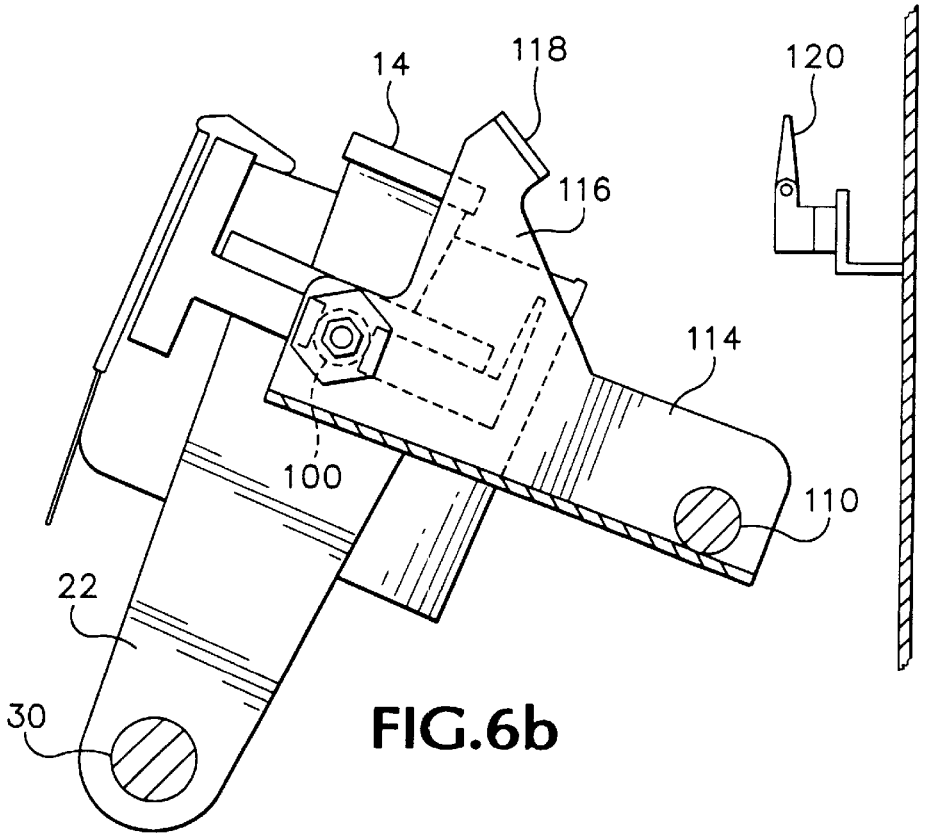
FIG. 6*b* is a side elevational view taken along the section line 6*b*—6*b* in FIG. 5 showing the print head in a maximum tilt position and the restraint mechanism engaging the print head.

With continued reference to FIGS. 4 and 5, when the carriage 20 and print head 14 are in the restraint position an engaging mechanism moves the engaging apparatus into engagement with a second boss 106 in the print head. In the preferred embodiment, the engaging apparatus comprises a moveable pin 100, and the engaging mechanism comprises a shaft 110 that is slidably and rotatably mounted in the printing apparatus 10. A substantially U-shaped bracket 112 is fixedly attached to the shaft 110 and includes a flange 114 from which the moveable pin 100 extends. With reference now to FIGS. 4 and 6*a,* the flange 114 includes a tab portion 116 having a contacting surface 118 that trips a sensor 120 when the moveable pin 100 is in a disengaged position.

As shown in FIGS. 4 and 5, a coil spring 122 biases the shaft 110 toward the disengaged position (FIG. 4). With reference now to FIG. 6*a,* the print head 14 is shown in the printing position of 0 degrees tilt and the moveable pin 100 and engaging mechanism are in the disengaged position. In an important aspect of the present invention, this configuration positions the moveable pin 100 and engaging apparatus away from and in a non-interfering relationship with the travel path of the print head 14 during printing. Advantageously, the print head 14 is thereby free to translate any desired distance in the directions of action arrows X or $X^1$ (FIGS. 2 and 4) without interference from the restraint mechanism. This configuration enables, for example, wide format printing in which the print head 14 translates a substantial distance to deposit the ink image on the drum 12.

As best seen by comparing FIGS. 4 and 6*a,* from the disengaged position the pin 100 must be translated in the direction of action arrow X' and rotated in the direction of action arrow R about the axis of rotation 109 of the shaft 110 to be aligned with and engage the second boss 106 in the print head 14. To impart this movement to the pin 100, the engaging mechanism includes a positioner housing 130 that is affixed to a side plate 11 within the printing apparatus 10. As shown in phantom outline in FIGS. 4, 5, 9*a* and 10, a first end 111 of the shaft 110 extends through the side plate 11 and into the positioner housing 130. A follower slot 132 located on a face 134 of the housing 130 includes an angled portion 133 that is angled with respect to the axis of rotation 109 of the shaft 110. A follower pin 136 extends from the shaft 110 through the follower slot 132. As best seen by comparing FIGS. 4–5 and 9*a*–10, when the shaft translates in the direction of action arrow X', the follower pin 136 is moved by the follower slot 132 to impart an angular rotation to the shaft 110 about its axis of rotation 109. In this manner, the moveable pin 100 is moved from the disengaged position into engagement with the second boss 106 in the print head 14.

To allow an operator to actuate the print head restraint mechanism, in the preferred embodiment a push-button 140 is provided at a second end 113 of the shaft 110. As shown in FIG. 1, the push-button is accessible to an operator via a recessed portion 15 in a side panel 17 of the printing apparatus 10. As seen by comparing FIGS. 4 and 5, depressing the push-button 140 translates the shaft 110 in the direction of action arrow X' and moves the pin 100 into the second boss 106. Preferably, the push-button 140 includes a push-and-turn locking feature (not shown) that allows an operator to depress and selectively lock the button such that the pin 110 is maintained in engagement with the second boss 106.

Figure 7:
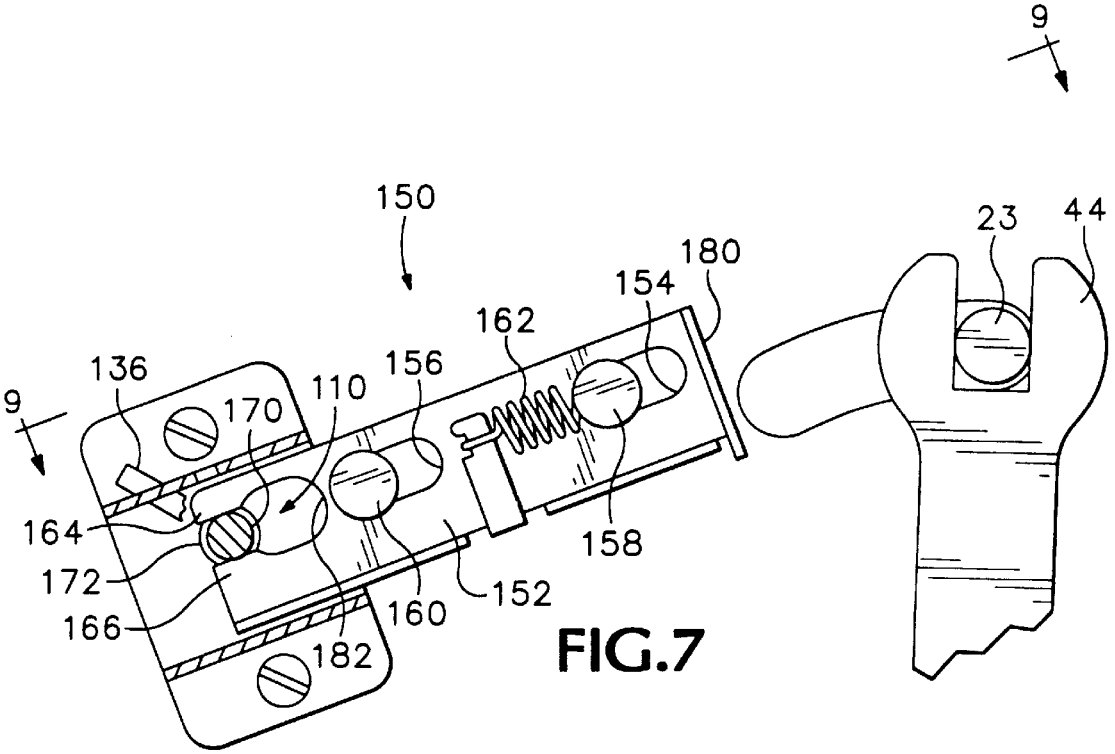
FIG. 7 is a partial side elevational view showing an interlock in a first position and the fork of the tilt arm positioned in the printing position.

With reference now to FIGS. 7–10, the print head restraint mechanism of the present invention includes an interlock, generally indicated by the reference numeral 150, for selectively preventing translation of the shaft 110 when the print head 14 and carriage 20 are away from the restraint position. As shown in FIG. 7, in the preferred embodiment the interlock 150 includes an elongated interlock member 152 that contains first and second guide slots 154, 156. Extending from the side plate 11 and through the first and second guide slots 154, 156 are first and second guide pins 158, 160, respectively (see also FIG. 5). A return spring 162 biases the interlock member 152 toward a first position (FIG. 7).

Figure 8:
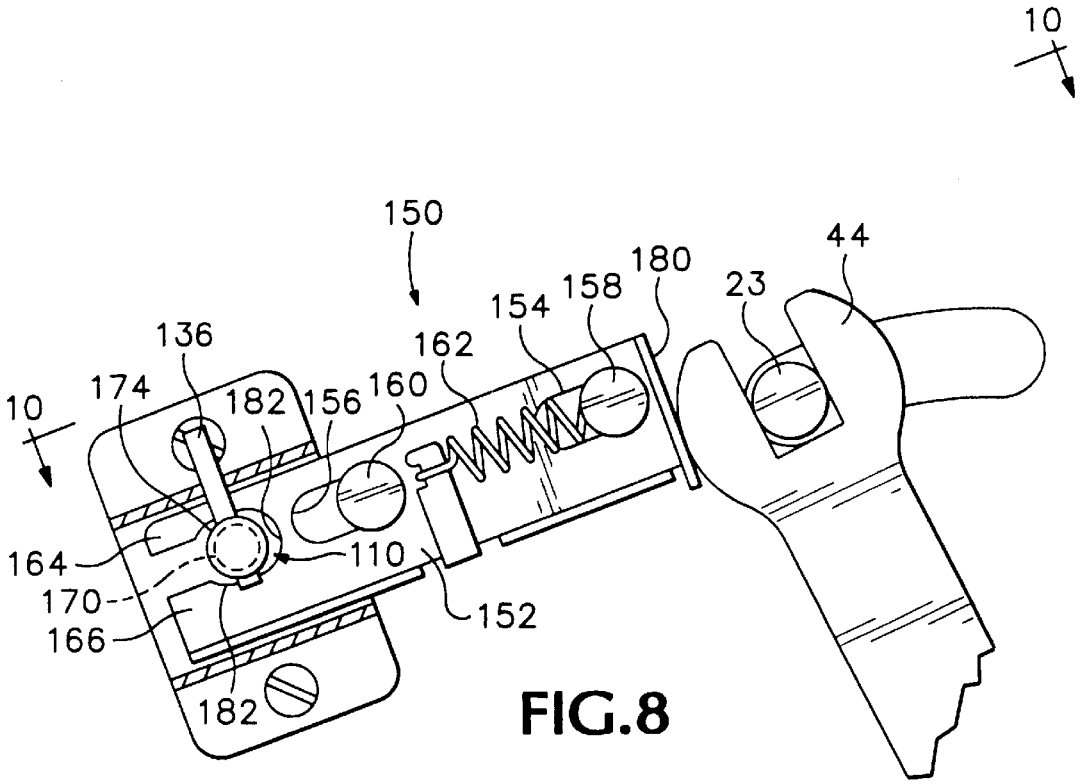
FIG. 8 is a partial side elevational view taken along the section line 8—8 in FIG. 5 showing the fork positioned in the maximum tilt position and contacting the interlock to maintain the interlock in a second position.
Figure 9A:
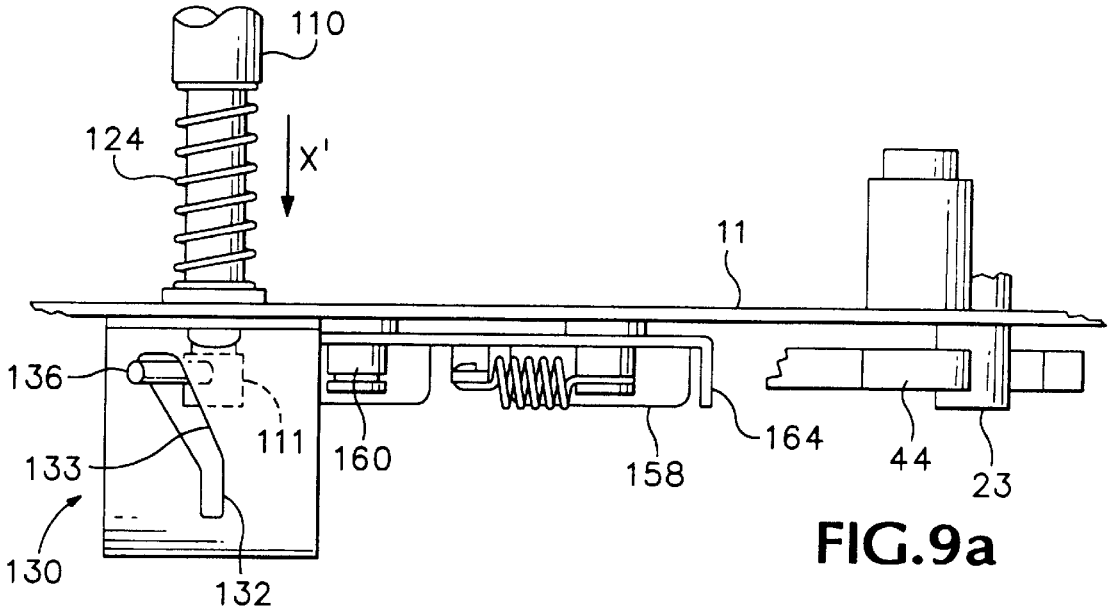
FIGS. 9*a* and 9*b* are partial top elevational views taken along the section line 9—9 in FIG. 7 showing the interlock in the first position and the shaft of the restraint mechanism in the disengaged position.
Figure 9B:
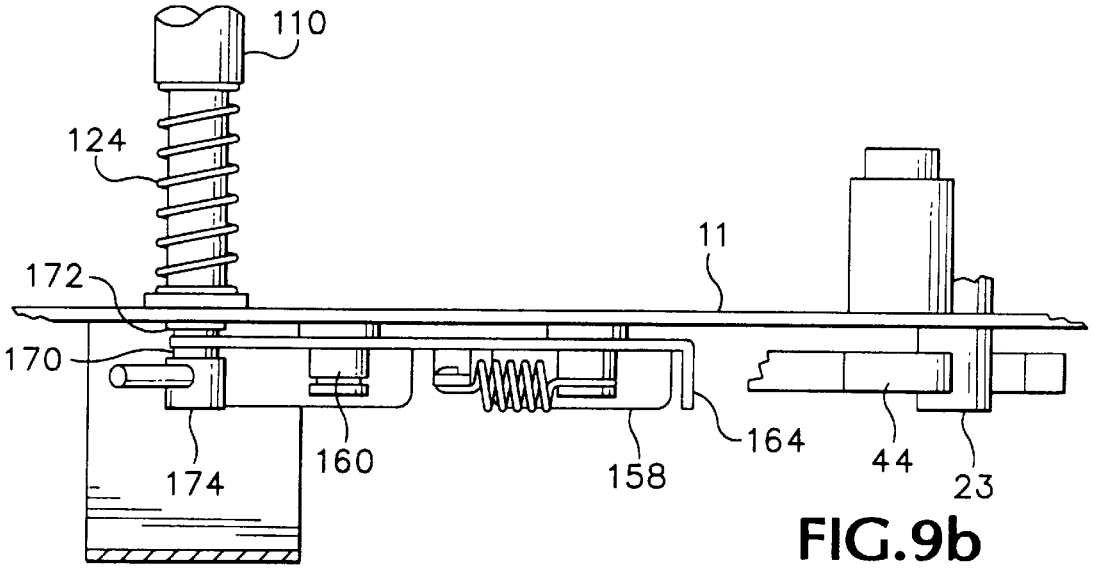
Figure 10:
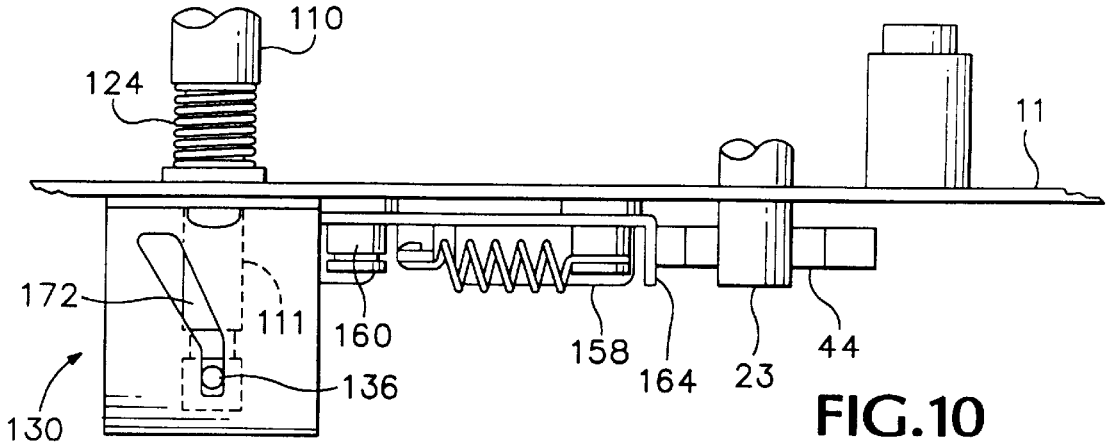
FIG. 10 is a partial top elevational view taken along the section line 10—10 in FIG. 7 showing the interlock in the second position and the shaft of the restraint mechanism in the engaged position.

With reference now to FIGS. 7, 8 and 9*b,* the shaft 110 includes a first portion 170 having a diameter that is less than the diameter of a second portion 172 and a third portion 174 on either side of the first portion. As best seen in FIGS. 7 and 8, the interlock member 152 includes opposing parallel restraint surfaces 164, 166 that are spaced apart by a distance that is greater than the diameter of the first portion 170 of the shaft 110 and less than the diameter of the second and third portions 172, 174 of the shaft. As shown in FIG. 7, when the interlock member 152 is in the first position, the restraint surfaces 164, 166 are positioned on opposite sides of the first portion 170 of the shaft 110 and adjacent to the second portion 172 of the shaft. Should an operator attempt to depress the push button 140 to actuate the restraint mechanism, the larger diameter second portion 172 of the shaft 110 will contact the sides of the restraint surfaces 164, 166 and prevent translation of the shaft. Advantageously, this prevents an operator from actuating the restraint mechanism when the print head is not tilted and positioned in the restraint position.

As seen by comparing FIGS. 7 and 8, as the print head 14 is tilted to the restraint position (FIG. 8), the fork 44 engages a contact surface 180 on the interlock member 152 and pushes the interlock member to a second position shown in FIG. 8. Adjacent to the restraint surfaces 164, 166 is an aperture 182 with an inner periphery that is larger than the diameter of the second portion 172 of the shaft 110. In this manner, when the print head 14 is in the restraint position, the shaft 110 may freely translate through the aperture 182 to allow the restraint mechanism to be engaged.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally, and equitably entitled. All patents cited herein are incorporated by reference in their entirety.

What is claimed is:

1. A print head restraint mechanism for restraining a print head during transport, the print head forming part of a printing apparatus for ejecting ink at an image-receiving medium, the printing apparatus including at least one side plate, the print head being spaced apart a distance from the image-receiving medium and moveable in a travel path parallel to the image-receiving medium, the print head restraint mechanism comprising:

an engaging apparatus that engages with and disengages from the print head to limit movement of the print head, the engaging apparatus being positioned away from and in a non-interfering relationship with the travel path of the print head during printing; and an engaging mechanism for moving the engaging apparatus into and out of engagement with the print head when the print head is positioned in a restraint position, the engaging mechanism connected to the side plate of the printing apparatus.

2. The print head restraint mechanism of claim 1, further including a sensor space from the engaging apparatus for detecting when the engaging apparatus is in a disengaged position.

3. The print head restraint mechanism of claim 2, wherein the sensor detects when the engaging apparatus is not in the disengaged position.

4. The print head restraint mechanism of claim 3, wherein the engaging mechanism further includes a shaft and a biases that biases the shaft and the engaging apparatus toward the disengaged position.

5. The print head restraint mechanism of claim 4, further including a positioner housing located at a first end of the shaft, the positioner housing having a follower slot including at least a portion that is angled with respect to an axis of rotation of the shaft, and wherein a follower pin extends from the shaft through the follower slot such that when the shaft translates parallel to the axis of rotation, the follower pin and follower slot cooperate to impart an angular rotation to the shaft.

6. The print head restraint mechanism of claim 5, wherein a button is positioned adjacent to a second end of the shaft such that when an operator depresses the button, the shaft and the engaging apparatus are translated and rotated to an engaged position in which the engaging apparatus engages the print head.

7. The print head restraint mechanism of claim 6, wherein the engaging apparatus comprises a moveable pin.

8. The print head restraint mechanism of claim 7, wherein a bracket connects the moveable pin to the shaft, the bracket including a flange that trips the sensor when the moveable pin is in the disengaged position.

9. The print head restraint mechanism of claim 8, further including a fixed pin that is positioned in the printing apparatus opposite to the moveable pin, the fixed pin engaging the carriage when the print head is in the restraint position.

10. The print head restraint mechanism of claim 9, wherein the image-receiving medium is a drum.

11. The print head restraint mechanism of claim 10, wherein the print head is an ink-jet nozzle array type.

12. The print head restraint mechanism of claim 11, wherein the printing apparatus is a solid ink color printer.

13. The print head restraint mechanism of claim 2, further including an interlock for selectively preventing translation of the shaft when the print head is away from the restraint position.

14. The print head restraint mechanism of claim 13, wherein the shaft includes a first portion having a diameter that is less than a diameter of a second portion of the shaft, and the interlock comprises an interlock member having opposing surfaces that are positioned on opposite sides of the first portion of the shaft and adjacent to the second portion of the shaft when the interlock member is in a first position, the opposing surfaces being spaced apart by a distance that is greater than the diameter of the first portion and less than the diameter of the second portion, whereby the opposing surfaces prevent translation of the shaft when the print head is away from the restraint position and the interlock member is in the first position.

15. The print head restraint mechanism of claim 14, wherein the interlock member further includes an aperture adjacent to the opposing surfaces, the aperture being larger than the diameter of the second portion of the shaft such that the shaft freely translates through the aperture when the print head is in the restraint position and the interlock member is in a second position.

16. The print head restraint mechanism of claim 15, wherein the interlock further includes a biaser that biases the interlock member toward the first position.

17. The print head restraint mechanism of claim 16, wherein the image receiving medium is a drum.

18. The print head restraint mechanism of claim 17, wherein the print head is an ink-jet nozzle array type.

19. The print head restraint mechanism of claim 18, wherein the printing apparatus is a solid ink color printer.

* * * * *